United S atates Patent [19]

Petersson

[11] Patent Number: 4,553,340

[45] Date of Patent: Nov. 19, 1985

[54] SEALINC EVICE IN A CYLINDER DRIER

[75] Inventor: Rolf Petersson, Eneryda, Sweden

[73] Assignee: Flakt Aktiebolag, Nacka, Sweden

[21] Appl. No. 511,143

[22] Filed: May 17, 1984

[30] Forei Application Priority Data

May 30, 1983 [S Sweden ..... 8303025

[51] Int. Cl.[4] .. ..... F26B 13/08

[52] U.S. Cl. ... ..... 34/114; 34/116; 34/117; 34/123

[58] Field of S ch ..... 34/114, 116, 117, 120, 34/122, 123

[56] References Cited

U.S. ATENT DOCUMENTS

| | | | |
|---|---|---|---|
| 3,702,503 | 11/72 | Nichols | 34/114 |
| 4,359,827 | 11/82 | Thomas | 34/114 |
| 4,441,263 | 4/84 | Vedenpaa | 34/123 |
| 4,502,231 | 3/85 | Fissmann et al. | 34/114 |
| 4,516,330 | 5/85 | Eskelinen | 34/114 |

FOREI PATENT DOCUMENTS

| | | | |
|---|---|---|---|
| 51055 | 5/82 | European Pat. Off. | 34/114 |

*Primary Examin* —Larry I. Schwartz

*Assistant Exami* —David W. Westphal

*Attorney, Agent, or Firm*—Oblon, Fisher, Spivak, McClelland & Maier

[57] ABSTRACT

The invention relates to a sealing device in a cylinder drier, intended for incorporation in a paper machine and including a plurality of cylinders arranged in two substantially parallel rows (1*a*,1*b*), the paper web (2) being trained serpentine about said cylinder during drying, said web being carried by an endless porous Fourdrinier drier (3) adapted for pressing the web against the cylinder surfaces in one row of cylinders and situated between the paper web and the cylinder surfaces in the other row. Two shielding members (7,15) being disposed in the space restricted by the wire and an intermediate cylinder surface on that cylinder which the wire and the web come onto and leave. Said shielding members facing the wire and extending substantially in parallel with and close to the wire and over the entire width of the web. The end portion of each shielding member being free and extending into the area for the nip between the wire and the intermediate cylinder, whereas the opposite end portion is connected to a blowing box (10,14) provided with openings for blowing air in directions which are substantially in parallel with or form an acute angle to the wire, said air jets being directed in the opposite direction relative to the corresponding shielding member.

14 Claims, 3 Drawing Figures

SEALING DEVICE IN A CYLINDER DRIER

Figure 1:
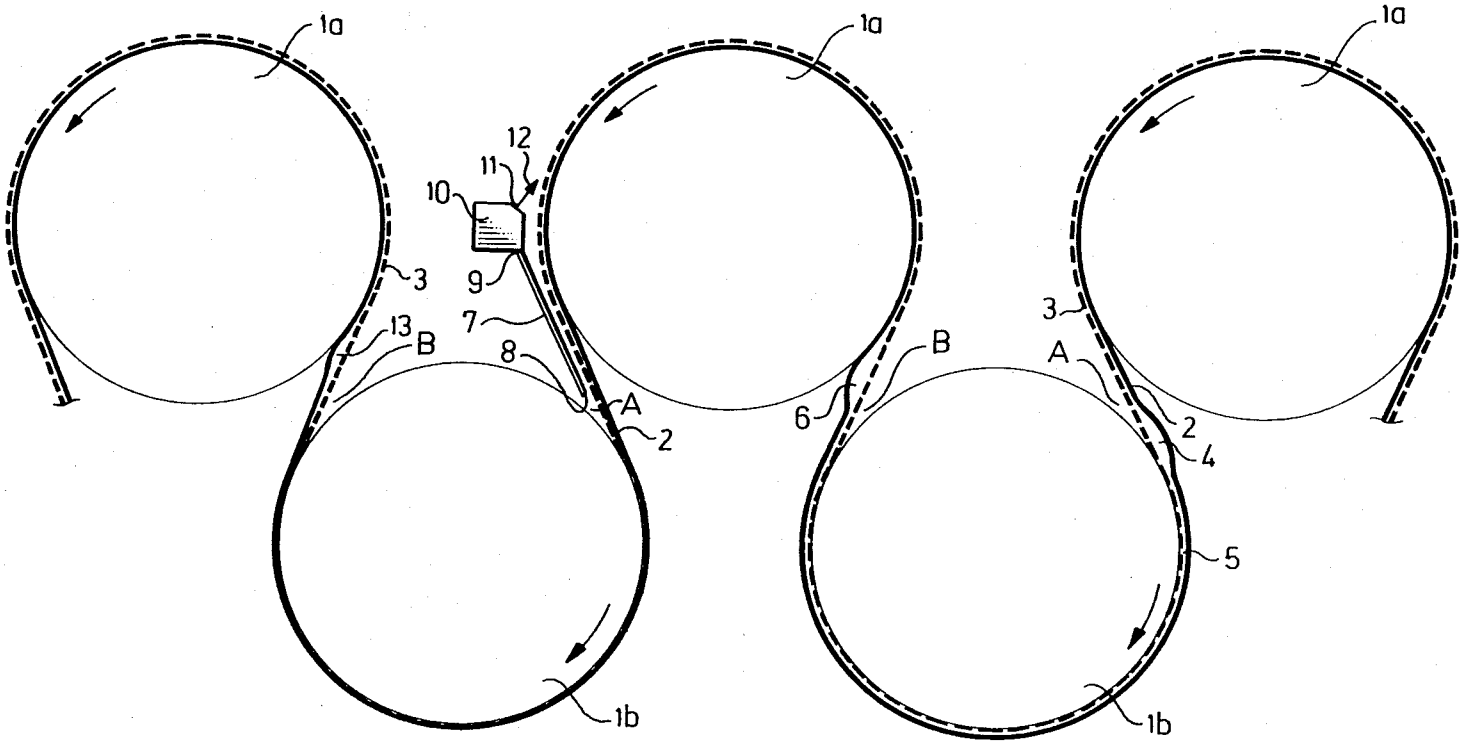

The present invention relates to a sealing device in a cylinder drier intended to be part of a paper machine and including a plurality of heated cylinders in two substantially parallel rows, about which the paper web is taken in a serpentine path during drying, while being carried by an endless Fourdrinier wire, the latter being adapted to press the paper web against the cylinder surfaces in one row of cylinders and being situated between the paper web and the cylinder surfaces in the other row, there being means provided to prevent the paper web from lifting from the wire due to pressure differences on either side of the web, when it is taken between the cylinders.

Sealing devices of the kind mentioned above are previously well known, for instance through SE patent applications Nos. 8201901-3 and 8107448-6. The object of the arrangements disclosed in these two applications is to eliminate the forming of blisters occurring when the wire makes contact with a cylinder and an excess pressure is created in the nip between the wire and the cylinder surface, which means that air flows through the porous wire and thereby lifts the web from the wire so that a blister will be formed. According to the first-mentioned Swedish reference such blistering is eliminated by forming an excess pressure in the cylinder pocket where the blister occurs in order to overcome the excess pressure in the nip at the same time as the boundary layer of air which is transported by the wire is "peeled off" by means of air jets which are blown in front of the nip and are directed towards the travelling direction of the wire. In the latter reference the excess pressure in the nip is reduced by placing blowing means within the area for the excess pressure nip and to direct air jets towards the travelling direction of the wire. These two suggested solutions have substantially reduced blistering in the excess pressure nip where the paper web is situated outside the wire but the problem has not been solved in connection with the formation of blisters in the excess pressure nip where the paper web is situated between the wire and the cylinder.

The object of the present invention is to eliminate blistering which occurs in the excess pressure nip where the web is situated outside the wire as well as in the excess pressure nip where the web is situated between the wire and the cylinder.

This object is realized according to the invention substantially through the fact that said means comprises two shielding members which are located in the space restricted by the wire and an intermediate cylinder surface on that cylinder which the wire and the web come onto and leave, said shielding member facing the wire and extending substantially in parallel with and close to the wire and substantially over the entire width of the web, and that each shielding member has a free end portion and extends into the area for the nip between the wire and the intermediate cylinder, whereas the opposite end portion is connected to a blowing box which is provided with openings for blowing air in directions being substantially in parallel with or at a certain angle to the wire and which are directed away from the shielding member, and that the free end portion of one of said shielding members is situated within the area for the excess pressure nip where the wire and the web come onto the intermediate cylinder and the air jets from the corresponding blowing box are directed towards the transport direction of the web, whereas the end portion of the other shielding member is situated within the area for the sub-pressure nip where the wire and the web leave the same cylinder, whereby the air jets from the corresponding blowing box are directed with the transport direction of the wire.

Figure 2:
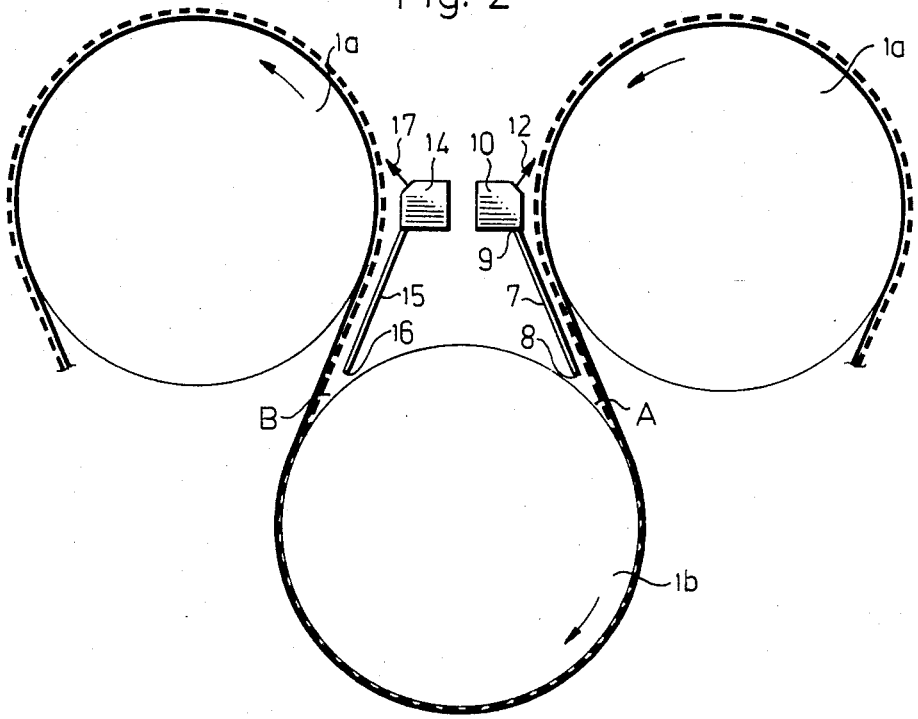
Figure 3:
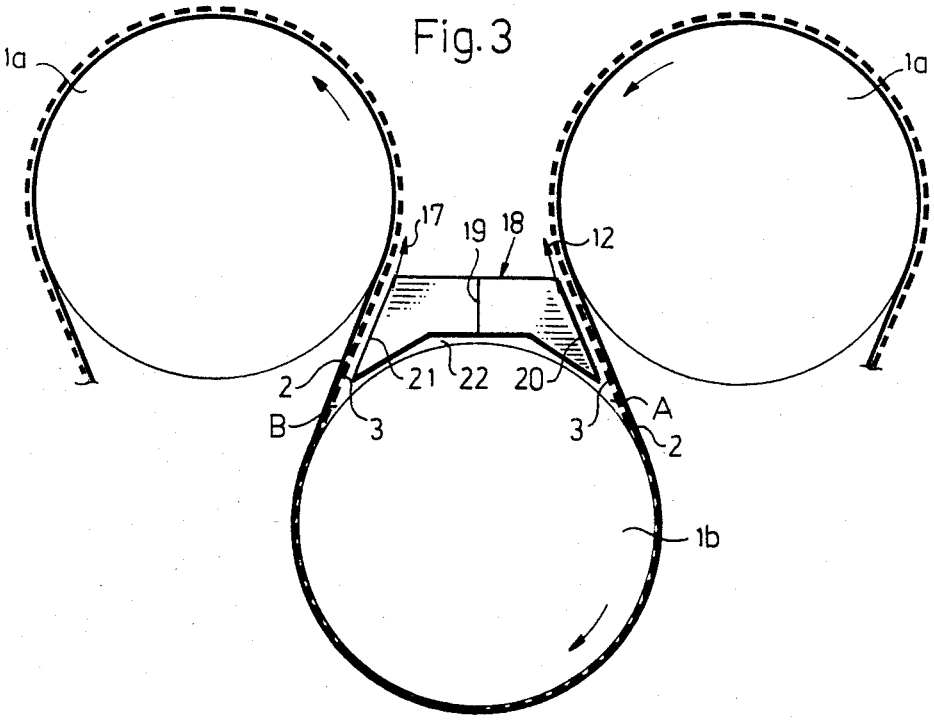

Some embodiments of the invention will now be described with reference to the accompanying drawings in which FIG. 1 shows a part of a cylinder drier without means to prevent blistering and another part with one half of a sealing device according to the invention, FIG. 2 shows an alternative embodiment of the sealing device according to the invention comprising two blowing boxes with shielding members, and FIG. 3 shows a further embodiment with the two blowing boxes and the sealing devices built together to form one unit.

FIG. 1 shows a portion of a drying section in a cylinder drier with two rows of heated cylinders 1 around which a paper web 2 is led in a serpentine path during drying, whereby the web is carried by an endless porous wire 3 both in the upper 1*a* and the lower 1*b* rows of cylinders in the drying section. This means that the wire 3 is outside the paper web on the upper cylinders 1*a* whereas the paper web 2 is outmost on the lower cylinders 1*b*. The permeability of the wire 3 has great importance in generating the air streams which are generated when the wire either comes onto or leaves a cylinder. If the wire has high porosity it will permit a great throughflow of air which means that air will flow through the wire 3 when it comes onto a cylinder since a zone will be created with excess pressure in the nip A between the wire 3 and the cylinder 1. Thus air will flow through the wire 3 and lift the comparatively dense paper web 2 from the wire so that a blister 4 is formed within the area from the excess nip. It has been found that this separation between the paper web 2 and the wire 3 occurs in the form of an air layer 5 along the entire peripheral surface of the lower cylinder 1*b*. This means that a second blister 6 is formed when the wire 3 and the paper web 2 are pressed together against the surface of the upper cylinder 1*a*. This lastmentioned blister 6 consequently depends on the fact that the wire offers a certain resistance against the air which is pressed through the wire when the paper web and the wire are pressed together against the upper cylinder 1*a*. This occurs in spite of the fact that a sub-pressure zone is generated in the nip B where a wire leaves the lower cylinder 1*b*. A further reason for formation of the blister 6 is that the web travels a longer path than the wire.

In order to eliminate the blister 4 at the excess pressure nip A, a shielding member 7 can be arranged to face the wire 3 and extend substantially in parallel with and close to the wire and substantially over the entire width of the web. One end 8 of the shielding member is free and extends to the area for the nip A between the wire 3 and the lower cylinder 1*b*. The second end 9 of the shielding member is connected to a blowing box 10 which is provided with openings in the form of slots 11 or eyelid perforations for blowing air in a direction 12 which is in parallel with or forms an acute angle to the wire in an opposite direction relative to the shielding device. By introducing the shielding member 7, air is mechanically prevented from being transported away by the wire 3, which means that the excess pressure in the nip A will be reduced. By connecting the upper end 9 of the shielding member 7 with the blowing box 10 and by blowing air in the direction 12 towards the travelling direction of the web 3 as indicated with an arrow, a certain evacuation of air occurs from the area at the nip A and thereby a certain sub-pressure is created within this area, which means that the blister 4 generated at the preceding cylinder 1*b* disappears. The air layer 5 between the web 2 and the wire 3 will also be considerably reduced by introducing the shielding member 7 and the blowing box 10 connected thereto. However, the air layer 5 and the fact that the web travels a longer path than the wire is still sufficient to generate a blister 13 at the excess pressure nip where the wire 3 comes onto the upper cylinder 1*a*.

In order to completely eliminate this blister a second sealing device according to the invention may be employed as illustrated in FIG. 2. In this construction a further blowing box 14 with a shielding member 15 is reversedly arranged relative to the shielding member 7 and the blowing box 10, as described in connection with FIG. 1. In this further sealing device, the free end 16 of the shielding member 15 is extended to the area for the sub-pressure in the nip B between the wire and the lower cylinder 1*b*. The air from the blowing box 14 is in this case blown in a direction 17 with the travelling direction of the wire which will enhance the airflow generated by the wire so that the sub-pressure in the nip B increases. This contributes to suck away the air layer 5 which forms the blister 13 when the wire 3 and the web 2 are pressed together as shown in FIG. 1. The air stream from the blowing box 14 thus enhances the pumping effect generated by the wire at the same time as the shielding member 15 prevents air from being transported by the wire 3 which will then transport air from the sub-pressure nip B. This means that the sub-pressure in the nip B increases, and the desired effect of eliminating the blister 13 shown is attained in FIG. 1. A greater sub-pressure will also be created between the shielding member 15 and the wire 3, which helps to evacuate the blister 13.

The embodiment according to FIG. 2 can be modified in the way shown in FIG. 3 where the two blowing boxes and the shielding member are built together to form one unit 18 which can suitably be divided with a partition wall 19 which makes it possible to individually control the airflows 12 and 17 which are directed to and with the conveying direction of the wire, respectively. The shielding members 20 and 21 extend as previously substantially in parallel with the wire 3 but also form an air slot 22 together with the lower cylinder 1*b* between the excess pressure nip A and the sub-pressure nip B. This embodiment effectively prevents ambient air from being transported by the wire within the sub-pressure area B, which contributes to increase the sub-pressure there and thus to prevent blistering in the excess pressure nip at the succeeding upper cylinder 1*a*.

I claim:

1. A sealing device in a cylinder drier for drying a paper web, intended for incorporation in a paper machine and including a plurality of cylinders having cylindrical surfaces arranged in two substantially parallel rows, the paper web being taken in a serpentine path during drying, while being carried in a transport direction by an endless porous Fourdrinier wire, the latter being adapted to press the paper web against the cylindrical surfaces in one row of cylinders and being situated between the paper web and the cylindrical surfaces in the other row, there being means provided to prevent the paper web from lifting from the wire due to pressure differences on either side of the web when it is taken between the cylinders, characterized in that said means comprises to shielding members which are located in a space restricted by the wire and an intermediate cylindrical surface on that cylinder which the wire and the web come onto and leave, said shielding members facing the wire and extending substantially in parallel with and close to the wire and substantially over the entire width of the web, and that each shielding member has a free end portion and extends into a nip area between the wire and the intermediate cylinder, the nip area between the wire and the intermediate cylinder where the wire comes into contact with the intermediate cylinder being an excess pressure nip and the nip area between the wire and the intermediate cylinder where the wire lifts off the intermediate cylinder being a sub-pressure nip, the opposite end portion of each shielding member being connected to a blowing box which is provided with openings for blowing air jets against the wire, the air jets being directed away from the shielding member, and in that the free end portion of one of said shielding members is situated within the nip area for the excess pressure nip where the wire and the web come onto the intermediate cylinder and the air jets from the corresponding blowing box are directed generally opposite the transport direction of the web, whereas the end portion of the other shielding member is situated within the nip area for the sub-pressure nip where the wire and the web leave the same cylinder, whereby the air jets from the corresponding blowing box are directed generally with the transport direction of the web.

2. Sealing device according to claim 1, characterized in that the end portions of the two shielding devices are interconnected by means of a third shielding member which is located at a distance from the intermediate cylinder in order to form a slot togeher with the intermediate cylinder, thereby defining a path between the excess pressure nip and the sub-pressure nip.

3. Sealing device according to claim 2, characterized in that the two shielding members as well as the blowing boxes are built together to form one unit.

4. Sealing device according to claim 2, characterized in that the air jets are blown in directions which are at an acute angle to the wire.

5. A paper making machine comprising:

(a) at least three heated cylinders each of which has an outer cylindrical drying surface;

(b) an endless, porous Fourdrinier wire trained around said cylinders in serpentine fashion such that, during use of said cylinders to dry a paper web, said wire is outside the paper web on the first of said at least three cylinders, inside the paper web on the second of said at least three cylinders, and outside the paper web on the third of said at least three cylinders, said wire coming into surface contact with said second cylinder at a first acute angle, whereby the outer surface of said second cylinder and the inner surface of said wire constitute an excess pressure nip zone adjacent to the line where said wire makes contact with the outer surface of said second cylinder, and said wire breaking surface contact with said second cylinder at a second acute angle, whereby the outer surface of said second cylinder and the inner surface of said wire constitute a sub-pressure nip zone adjacent to the line where said wire breaks contact with the outer surface of said second cylinder;

(c) a first shielding member located at least substantially parallel to but spaced from said wire between said first and second cylinders, said first shielding member having a free end portion which extends into the excess pressure nip zone and an opposite end portion located upstream of the excess pressure nip zone;

(d) first means for blowing a curtain of air from said opposite end portion of said first shielding member against said wire in the direction opposite to the direction of motion of said wire, thereby creating an under pressure in the space between said first shielding member and said wire which is communicated to the excess pressure nip zone and which reduces the excess pressure in the excess pressure nip zone;

(e) a second shielding member located at least substantially parallel to but spaced from said wire between said second and third cylinders, said second shielding member having a free end portion which extends into the sub-pressure nip zone and an opposite end portion located downstream of the sub-pressure nip zone; and (f) second means for blowing a curtain of air from said opposite end portion of said second shielding member against said wire in the direction of motion of said wire, thereby creating an underpressure in the space between said second shielding member and said wire which is communicated to the sub-pressure nip zone and which further reduces the pressure in the sub-pressure nip zone.

6. A paper making machine as recited in claim 5 wherein:

(a) said first shielding member extends substantially the entire distance between said first and second cylinders;

(b) said opposite end portion of said first shielding member is located adjacent said first cylinder; and (c) the curtain of air blown by said first means impinges against said wire while said wire is trained around said first cylinder.

7. A paper making machine as recited in claim 6 wherein:

(a) said second shielding member extends substantially the entire distance between said second and third cylinders;

(b) said opposite end portion of said second shielding member is located adjacent said third cylinder; and (c) the curtain of air blown by said second means impinges against said wire while said wire is trained around said third cylinder.

8. A paper making machine as recited in claim 5 wherein:

(a) said second shielding member extends substantially the entire distance between said second and third cylinders;

(b) said opposite end portion of said second shielding member is located adjacent said third cylinder; and (c) the curtain of air blown by said second means impinges against said wire while said wire is trained around said third cylinder.

9. A paper making machine as recited in claim 5 wherein said first means is a blow box.

10. A paper making machine as recited in claim 9 wherein said second means is a blow box.

11. A paper making machine as recited in claim 5 wherein said second means is a blow box.

12. A paper making machine as recited in claim 5 wherein:

(a) said free end portion of said first shielding member and said free end portion of said second shielding member are interconnected by a third shielding member which is at least substantially concentric to but spaced from the outer surface of said second cylinder and (b) the space between the outer surface of said second cylinder and the inner surface of said third shielding member communicates the sub-pressure nip zone to the excess pressure nip zone.

13. A paper making machine as recited in claim 12 wherein said opposite end portion of said first shielding member and said opposite end portion of said second shielding member are interconnected by an end closure wall, whereby said first, second, and third shielding members and said end closure wall constitute portions of a single blow box.

14. A paper making machine as recited in claim 13 and further comprising a partition wall extending from said third shielding member to said end closure wall, whereby said first and second means can be controlled individually.

* * * * *